US008454458B2

(12) United States Patent
Nicodem et al.

(10) Patent No.: US 8,454,458 B2
(45) Date of Patent: Jun. 4, 2013

(54) GOLF PUTTING PRACTICE DEVICE AND METHODS OF PRACTICING PUTTING THEREOF

(76) Inventors: Harry E. Nicodem, McHenry, IL (US); Fred Knecht, Woodstock, IL (US)

( * ) Notice: Subject to any disclaimer, the term of this patent is extended or adjusted under 35 U.S.C. 154(b) by 0 days.

(21) Appl. No.: 13/311,239

(22) Filed: Dec. 5, 2011

(65) Prior Publication Data

US 2012/0135815 A1 May 31, 2012

Related U.S. Application Data

(63) Continuation of application No. 12/460,492, filed on Jul. 20, 2009, now Pat. No. 8,070,618.

(60) Provisional application No. 61/195,445, filed on Oct. 7, 2008.

(51) Int. Cl.
*A63B 69/36* (2006.01)
*A63B 37/00* (2006.01)

(52) U.S. Cl.
USPC ..... 473/409; 473/151; 473/164

(58) Field of Classification Search
USPC ..... 473/145, 150, 151, 154, 155, 164, 473/166, 174, 191, 198, 199, 222, 224, 225, 473/265, 409
See application file for complete search history.

(56) References Cited

U.S. PATENT DOCUMENTS

| | | | | |
|---|---|---|---|---|
| 5,692,966 | A * | 12/1997 | Wash | 473/221 |
| 7,255,649 | B1 * | 8/2007 | McConnell | 473/199 |
| 7,744,482 | B1 * | 6/2010 | Watson | 473/221 |
| 8,070,618 | B2 * | 12/2011 | Nicodem et al. | 473/164 |

* cited by examiner

*Primary Examiner* — Nini Legesse
(74) *Attorney, Agent, or Firm* — Jeffrey A. Pine; Dykema Gossett PLLC

(57) ABSTRACT

A golf putting practice device/simulator and ball return with no moving parts, and method for a golfer to practice putting a golf ball in which the device is located in close proximity to the golfer and the intended target can be of any normal putting distance allowing one to practice golf putts indoors of greater length than indoor spaces normally allow. The device is programmed and configured in such a way to accurately approximate the distance and to display the direction the golf ball would have traveled had the path of the ball not be interrupted by device. The practice device can be configured to account for a coefficient of resistance commonly know as the Stimp of the green in its calculations.

10 Claims, 4 Drawing Sheets

GOLF PUTTING PRACTICE DEVICE AND METHODS OF PRACTICING PUTTING THEREOF

This application claims the benefit of U.S. Provisional Application No. 61/195,445, filed Oct. 7, 2008.

This application is a CON of Ser. No. 12/460,492 filed Jul. 20, 2009 which is now U.S. Pat. No. 8,070,618

The present invention relates to a novel golf putting practice device and novel method of practicing the putting of a golf ball, and in particular, this invention relates to a novel golf putting practice device that provides useful information about each practice putt, including directional accuracy and distance control (distance is based on a user selected Stimp setting) and that returns the putted golf ball to the golfer without the use of moving parts and the method for practicing putts of a greater distance than available space allows. The present invention also relates to a number of games or methods of playing games in which the user is simultaneously practicing the putting of a golf ball.

BACKGROUND OF THE INVENTION

The first game of golf is believed to have occurred in Scotland in the 15$^{th}$ century, while other reports have the game originating in Holland or China. Regardless of the exact origination of the game, tens of millions of people play golf each year at tens of thousands of different golf courses all over the world.

The game of golf is played on a golf course. The course is usually made up of 18 unique holes; however, smaller courses have nine holes. A round of golf is played when a player plays all 18 holes (or nine holes on the smaller courses). Each hole is comprised of an area to start or an area to hit a tee shot, which is when the ball is placed on a tee. The hole also has a fairway and a green, where the hole or cup is located. The goal of the game of golf is to play the entire round or, in some cases each hole, in fewer strokes than your opponent.

In order to reduce the number of strokes during a round of golf, players use various clubs to hit or strike the golf ball. In order to reduce the number of strokes, different clubs, i.e., woods, irons and putters are used at different locations on the course.

Depending on the hole, a player may use a driver or a wood for the first stroke. Next, a player may use an iron, which substitutes some distance for accuracy. Finally, once the player reaches the green, a putter is usually used to putt the ball into the cup. Whereas it may only take two or three shots to cover 400 to 500 yards to get to the green, it may then take two or three putts to actually put the ball in the hole.

Adding to the difficulty of putting the ball into the hole is the composition of the green. Greens are never level and are sloped at varying gradients at different locations on the green. For example, one part of the green may slope down to a water hazard and away from the hole, while another part of the green slopes from the edge of the green to the hole. Adding to the difficulty is the placement of the hole, which will vary from day to day.

The grass on the green is also cut extremely short, much shorter than in the fairway or rough. The green is also rolled often to compress the green even more making putting even more difficult. Further, depending on conditions of the green, putting on a dry green is more difficult than putting on a moist or wet green.

A device that has been useful for determining the speed of a putting green is the Stimpmeter, which is used to measure the green's coefficient of resistance. The Stimpmeter device releases a golf ball down a V-shaped groove at about a 20° slope such that the velocity of the golf ball is accurately known when it leaves the Stimpmeter device onto the green. The distance the golf ball then travels over the green is measured (in feet) and averaged for multiple locations on the particular putting green. The faster greens will return higher numbers. These numbers are commonly known as "Stimp". The USGA recommends that slow greens have a Stimp of about 8.5 feet, medium greens have a reading of about 10.5 feet, and fast greens have a reading of about 12.5 feet. For professional tournaments, slow greens may have a Stimp of about 10.5 feet, medium greens a reading of about 11.5 feet, and fast greens a reading of about 12.5 feet. The Stimp on some of the fastest greens on the PGA tour may be 12 to 15.

Since each shot, whether using a wood, an iron or a putter, counts the same, it is extremely important for a player to reduce the number of putts to get the ball into the hole, once the green is reached. It is clear that one way to improve the score of one's golf game is by reducing the number of putts used in a round to put the ball in the hole once the ball is on the green. Repetition is the key to a successful putting stroke and by practicing one's putting stroke, a player can teach himself or herself to replicate the same putting stroke each time, thereby increasing the reliability that the golf ball will go the proper distance and location each time.

Then, once the distance is known and the break of the ball on the green is determined, the player can be sure that with enough practice, the putt will generally go where it is supposed to go. When the player takes into account additional factors, such as the Stimp for the green, the putting accuracy can be further improved.

Although there are a number of golf putting practice devices that allow a golfer to practice a golf putt and which return the golf ball to the golfer, they use moving parts to return the ball to the player each time. In order to simulate actual putting, they need to be placed at a location the same distance from the golfer that the hole would normally be located, and if the golfer misses the target, the ball may not be returned properly. Further, none of the existing golf putting practice devices calculate the distance the ball would travel on a real green based on the speed of the ball and taking into account the putting green's coefficient of resistance or Stimp.

To the extent that the repetition or practicing of the putting stroke can be accomplished in a game format, the practicing will be more enjoyable, allowing the golfer to practice for a longer period of time.

Accordingly, it would be a great advantage to use a putting practice device that indicates how far the golf ball will travel using a varying hypothetical Stimp value. In addition, it would be helpful if the practicing device could be used at a closer distance to the golfer so that a longer ball travel path was not necessary allowing one to practice putts of greater distance than available space allows, and the ball would always come back to the golfer.

It would also be advantageous to have a golf putting practice device that was battery operated without the need to be plugged into a wall outlet, and that had no moving parts (especially for the ball return) that could break down or improperly function. It would also be advantageous to have a device that could be turned on and off by using one's foot thereby reducing the strain that comes with bending down to turn the game on or off (or to change the various game play).

It would also be advantageous to have a golf putting practice device that could play various games for both entertainment as well as to make the repetitive practicing more enjoyable.

SUMMARY OF THE INVENTION

The present invention is a novel golf putting practice device and method that allows a golfer to practice his or her putting, by placing the device a short distance away regardless of the distance of the putt being practiced. The present invention contains a solid wall, rigid beam or bounce beam for which the putted golf ball will make contact and return to the golfer. As such, whether the putting distance being practiced is ten feet or thirty feet, the practice device can be placed as little as three feet away from the golfer. The configuration of the bounce beam eliminates the need for edges or ramps, which direct or redirect the putted golf ball into a slot or location, where external energy is used to return the golf ball to the golfer. These edges or ramps act to change the speed and/or direction of the putted golf ball creating inaccuracies in calculating ball speed and position. Instead, the novel present invention allows the putted golf ball to roll unimpeded to the bounce beam.

The device contains at least two optical sensors to capture ball speed and position. However, the invention is not so limited to the method in which capturing the golf ball speed and position is determined. Accordingly, accelerometers can be placed at the ends of a bounce beam, and the impact data from each end of the bounce beam can be used to calculate ball speed and position. Of course, other methods can be used to practice the present invention. The present invention may be battery operated or use a cord for plugging into a standard wall outlet.

The present invention includes a computer (or microprocessor) and two displays, one for indicating to the user the direction of each practice putt, and one for indicating the distance of each practice putt (if the ball were allowed to continue past the device). It should be understood that, although two displays are described herein, any number of displays can be used to indicate the same or additional information, within the scope of the present invention. The calculation of the distance takes into consideration a coefficient of resistance, i.e., the Stimp, for a particular putting green. The Stimp setting can be varied by the golfer to simulate putting on putting greens of different speeds. The putt speed and direction is captured just before the ball makes contact with the bounce beam.

An objective of the present invention is to provide a device and method for practicing golf putting using a small electronic indoor putting practice device with a ball return feature that consists of a bounce beam and no moving parts. The device provides repeatable, convenient putting practice anywhere one can roll a golf putt. The device enables one to practice longer putts than the available space will allow.

An object of the present invention is to incorporate optical sensors, an onboard microprocessor, at least one light emitting diode (LED) linear array, and a digital display to provide instant feedback in the critical areas of putt execution; i.e., direction and distance. The LED array(s) can be located above or below the area where the golf ball makes contact with the device in order to protect the individual LEDs. Further, using a reflective or semi-reflective surface, the LED array can be located such that the golfer will see the reflected LED array off of the reflective area thereby protecting the LEDs from damage due to the golf ball and still allowing the golfer to see the light from the LEDs.

To provide a superior indication of the ball strike position, the reflective or semi-reflective surface incorporates a means of optically scattering the incoming, roughly circular beam, as emitted by the LEDs in the linear array, into a substantially line-shaped reflected image. This line generation technique provides the golfer with a clear target before attempting a putt, and an improved indication of ball strike position after the putt has been completed.

The device incorporates a rigid bounce beam positioned approximately perpendicular to the direction of the putting line and just above the putting surface. The putted golf ball strikes this bounce beam, which has sufficient mass to stop and reflect the golf ball back to the user without the device moving out of position. The present invention allows a golfer to aim at a target (the target is created by selectively illuminating one or more individual LEDs on the LED array) in the center of the bounce beam, the bounce beam is wide enough to capture and return the ball whether or not the golf ball hit the center of the device. Because this device is typically used to practice putts of greater distance than space allows, the golf ball bounces off the bounce beam with enough energy to be returned to within reach of the user. By selectively illuminating individual LEDs on the array, the LED array can also indicate where the golf ball made contact with the bounce beam, hereby providing instant visual feedback to the user as to his or her directional accuracy.

An object of the present invention is to incorporate at least two optical sensors strategically placed in front of the bounce beam. The golf ball approaching the bounce beam interrupts the optical sensors just prior to striking the bounce beam, and the optical sensors, which can consist of one emitter and two receivers in the preferred embodiment, are positioned in such a way that the duration and timing of interruptions of the optical sensors is captured and used to determine both the speed and position of the ball in front of the beam.

The microprocessor used in the present invention is programmed to calculate ball speed and ball position relative to the center of the device based on the timing of the signals received from the optical sensors. In the preferred embodiment, one LED array is positioned horizontally just above the center of the bounce beam and is intended to display a target, and the point of ball contact on the bounce beam calculated by the microprocessor using input from the optical sensors. The light from the LED array is reflected off the bounce beam toward the user, however, the LED array can also be positioned in, above, or below the bounce beam to achieve similar results. The digital display displays the estimated distance the ball would have rolled (if allowed to continue past the device) based on two factors: the speed of the ball at the time the ball crosses the sensors, and the user selected putting green coefficient of resistance, or the hypothetical Stimp of the green. A second linear array is positioned, near the digital display, as an arc of multicolor LEDs and this array is used to display the real-time deceleration and resulting rollout of the ball as calculated by the microprocessor using the known ball speed and the Stimp preference.

The LED array can also display a visually correct, proportionally sized golf cup depending on the hypothetical cup distance. The further the hypothetical hole is away from the golfer, the smaller the cup should be. Thus, if the hypothetical hole is five feet from the golfer, for example, the LED array may use fifteen LEDs to indicate the size of the cup, while if the hole is twenty feet away, the LED array may use two LEDs and if it is forty feet away, only one LED on the array is needed to indicate the hypothetical cup size. Further, the target can be programmed to move across the bounce beam (or reflected across the bounce beam) so that the golfer must time the putt to hit the bounce beam when the light is at the same point. These embodiments (and others) can be used to generate numerous games.

In another embodiment, multiple colored LEDs may be used to replicate the green, the hole, and where the ball strikes the beam. For example, green LEDs can indicate the actual putting green and a different color or the absence of light, to indicate the hole. When the golf ball strikes the bounce beam, a white LED can be turned on at that spot. By employing persistent storage and display of successive hit locations, the golfer can see, after a series of putts, where the majority of his/her putts tend to go; this is good feedback and helps the golfer. Of course, there are numerous LED color combinations that can be used to indicate the target and where the golf ball strikes the beam.

Using the ball speed information, the present invention can be set to display the correct distance for each practice putt based on various putting green speeds. These green speeds can be entered into the device through a keypad or other type of data entry, as understood by one having ordinary skill in the art. Based on this information, the device can determine if the ball was struck well enough to reach the hole. As an example, if a Stimp of 12 is entered into the system, the same golf ball speed will display a further distance traveled than if the Stimp was set to 9.

The primary function of the LED array is to instantly indicate to the user the directional accuracy of the putt. Once a putted ball interrupts the optical sensors, the microprocessor calculates the ball position in front of the bounce beam by comparing the signals received from the optical sensors. The microprocessor then illuminates the corresponding LED on the array that indicates where the ball struck the bounce beam.

The LED array can also be programmed to display many different patterns, timed sequences and movements to create challenging skill tests and games. For example, a game called 500 can be played using the present invention. To play the game, a player must putt a golf ball five times, each time the ball contacts the bounce beam, a score of 1 to 100 is revealed to the golfer—100 for a perfect shot, with reducing scores for less accurate putts. The present invention keeps track of the five different scores and displays a total after all five shots, with 500 being a perfect score. The game can be played by one person (trying to better his or her score), or by multiple players each trying to register the highest score.

Another game that can be programmed is called Knockout, in which the objective is to turn off all of the LEDs in the target area with the least number of putts. At the start of the game, all of the LEDs in the target area are on and visible, (either directly or reflected.) As the putted golf ball makes contact with the bounce beam, the LEDs near the point of contact are turned off until all of the LEDs in the target area are turned off. The display then indicates how many putts it took for the player to turn off all of the LEDs. For example, if 16 LEDs are on at the beginning of the game and each putt can turn off four LEDS, then four precise putts can turn off all of the LEDs. However, it may take many more putts to turn off all of the LEDs. This type of game can be played by multiple players, each trying to "use" the least number of putts, or it can be played by one, trying to better the lowest score each time.

The game Diminishing Hole is another example of a game using the present invention. In Diminishing Hole, the player obtains points by hitting the golf ball into the area where the LEDs are on. After each successful hit, the number of LEDs on is reduced making the next shot (and the chance at points) that much more difficult. After three misses, the game ends. In another embodiment of this game, the LEDs (or LED) that is on are moving side to side and the player gets points for hitting the bounce beam at the location of the LED at the time the particular LED is on.

Of course, there are numerous other games that can be programmed and played using the present invention.

The present invention can also utilize a larger digital display to display graphics that simulate a putting green, golf hole, and simulates a ball rolling on a green for a distance and then dropping into a hole.

The digital display may be removable using Bluetooth or another wired or wireless communication technology to allow the player to place the display (and touch screen) closer to be able to see the results or to change the various settings. A speaker can be combined with the device providing the audio of a ball dropping into the hole (and also the gallery cheering) to enhance the simulation when a putt is made. Depending on the accuracy of the putt (where on the bounce beam the golf ball makes contact as opposed to where it is supposed to make contact) a predetermined audio recording can be played. For example, if the putt is on target, the sound of a golf ball dropping into a cup can be played along with a cheering gallery, whereas, if the putt misses the mark significantly, the sound of people booing can be heard. Further, depending on the accuracy of the putt, the system can randomly choose one audio recording from a particular group of recordings; with a number of different groups. As such, two identical accurate putts will play different (random) audio recordings, while two identical terrible putts will also play different audio recordings, but from a different group.

The microprocessor can be programmed for different objectives to display a player's performance and score or to allow the player or players to play various games of skill. Further, the device can be wired or wirelessly coupled or linked to a personal computer, a gaming console and/or to the Internet to provide numerous programs for data collection, personal performance evaluation and entertainment alone or with others.

While the invention is described herein with relation to certain embodiments and applications, those with skill in this art will recognize changes, modifications, alterations and the like which still come within the spirit of the inventive concept, and such are intended to be included within the scope of the invention as expressed in the following drawings, description and claims disclosed herein.

DESCRIPTION OF THE PREFERRED EMBODIMENTS

The present invention is a novel golf putting practice device and method of practicing golf putting using a golf putting practice device placed a short distance away from the golfer regardless of the distance of the putt being practiced. The present invention contains a solid wall or bounce beam of sufficient weight and mass for which a putted golf ball will make contact and return to the golfer. The present invention eliminates impediments such as edges and ramps, which direct or redirect a putted golf ball into a slot where external energy is used to return the golf ball to the golfer. These impediments act to change the speed and/or direction of the putted golf ball creating inaccuracies in calculating ball speed and position. Instead, the present invention allows the putted golf ball to roll unimpeded to the bounce beam.

In the preferred embodiment, optical sensors detect the ball motion and a microprocessor or microcomputer calculates the putted golf ball's speed and position as it strikes the device. Other methods of determining ball speed and positioning, such as accelerometers (one placed at each end of the bounce beam), can be incorporated into the device, so that the ball speed and positioning can then be determined using the impact data from each accelerometer. Further, the present invention has the ability to take into consideration a coefficient of resistance otherwise known as the green's Stimp. The Stimp can be varied by the golfer to simulate putting on different speed putting greens. The present invention calculates the actual putt distance had the bounce beam not blocked the path of the golf ball.

Figure 1:
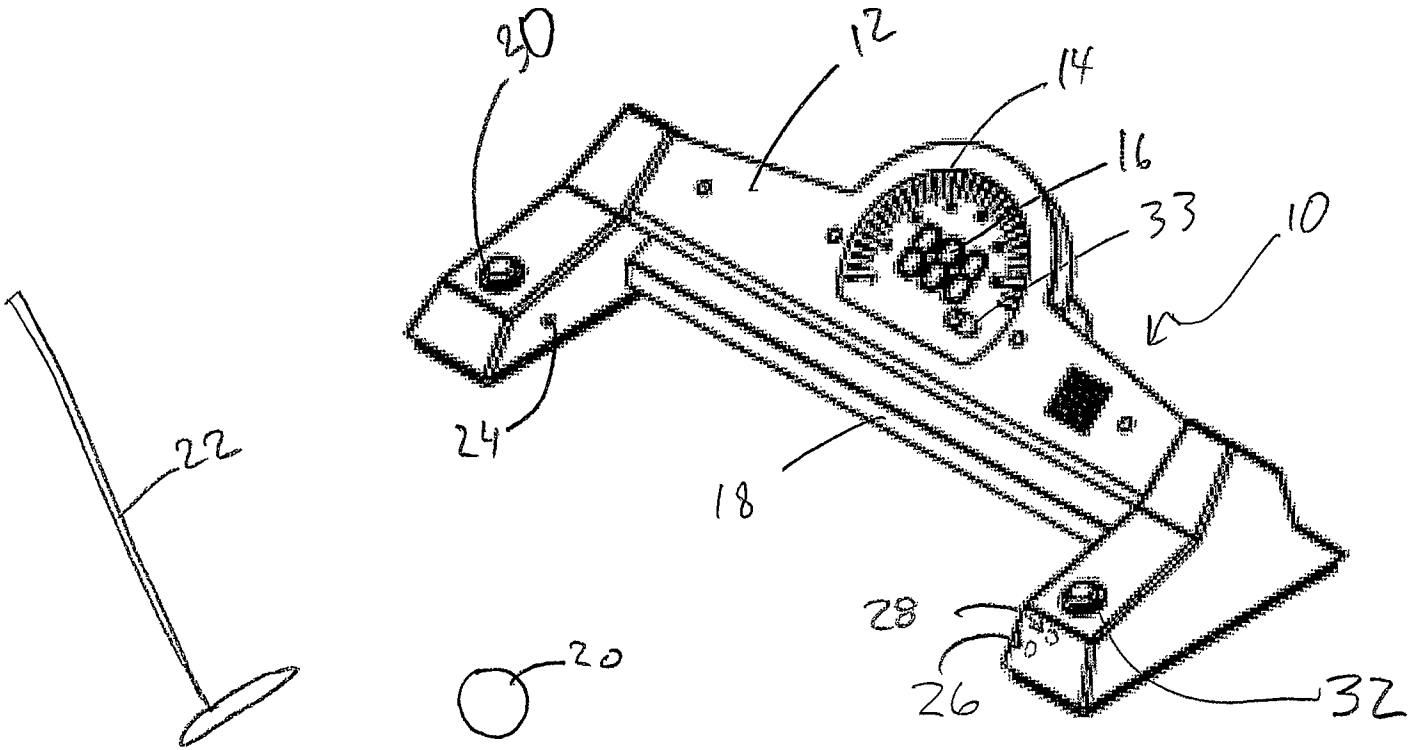
FIG. 1 is a perspective view of the golf putter practice device as the putted golf ball approaches and returns in accordance with the preferred embodiment of the present invention.

FIG. 1 illustrates a golf putting practice device 10 in accordance with the preferred embodiment of the present invention. The practice device 10 includes a housing 12 for enclosing a microprocessor (not shown) and the necessary components (software, memory chips, timers and the associated hardware and software) (not shown) necessary to perform the functions of the golf putting practice device 10. The present invention also includes a display 14 incorporated into the housing 12 in such a way to indicate various information 16 to the golfer, such as location, ball speed and actual distance the ball would have traveled, as described in more detail below. Although the preferred embodiment includes the display attached to the device 10, alternative embodiments can utilize displays 14 separated from the device 10 and receiving information for display wirelessly or wired. Further, the information can be sent to an existing display such as a television, a computer screen or PDA (Personal Digital Assistant).

In the preferred embodiment, the contents of box 12 may be incorporated into a single device such that the microprocessor and display 14, along with a bounce beam 18, are all incorporated into one package. However, the microprocessor and related components can be separate from the bounce beam 18 such that information can be transmitted wirelessly or wired to the microprocessor for processing, control and display.

The practice device 10 is configured to include a rigid beam or bounce beam 18 of sufficient weight and/or mass such that a golf ball 20 hit or putted by a golfer using a golf putter 22 will strike the bounce beam 18 with sufficient energy to return to the golfer without moving or shifting the putting practice device 10. The golf ball is thus returned to the golfer without any mechanical or moving parts, thereby reducing or eliminating the chance that the device will malfunction and fail to return the golf ball to the golfer.

In the preferred embodiment, the putting practice device 10 uses an emitter or transmitter 24 to generates optical beams (not shown) which are received by optical receivers 26 and 28. The optical beams are situated on the device 10 such that a putted golf ball 20 must break a first beam, then a second beam, before striking the bounce beam 18 and returning the golf ball 20 to the golfer. Although in the preferred embodiment, an optical transmitter 24 and receivers 26, 28 are utilized, there are a number of other devices that can be incorporated into the device 10 to capture the same information about the putted golf ball 20, such as accelerometer(s) strategically located on the bounce beam, piezoelectric elements, strain gauges, microphones, and others known by those having skill in the art.

Figure 2:
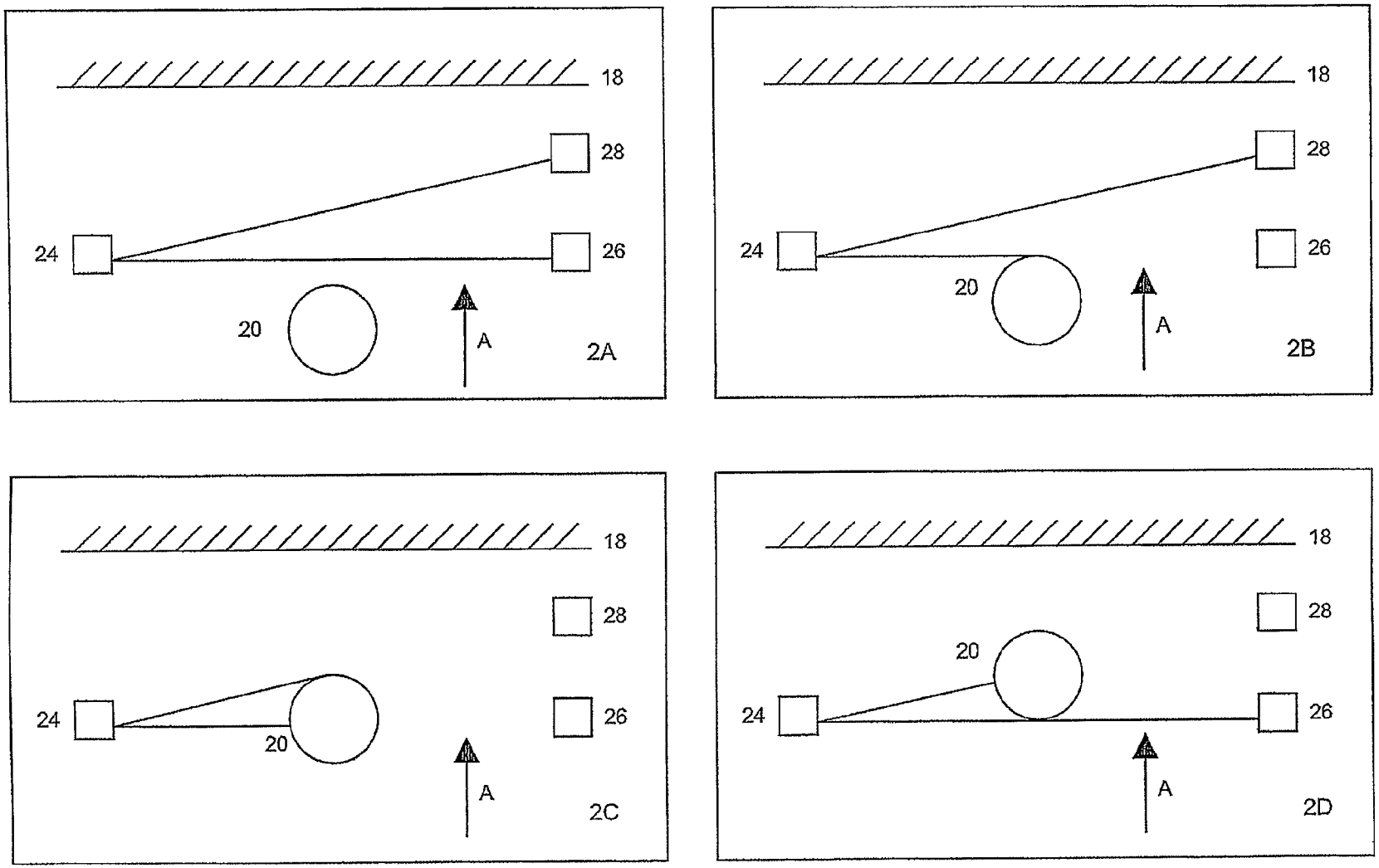
FIGS. 2A-2D are top-down views of the golf putter practice device in accordance with the preferred embodiment of the present invention.

FIGS. 2A through 2D show a top-down view of the sequence of a golf ball 20 after being putted towards the device 10, including the direction of travel (indicated by A, towards the beams) in relation to the bounce beam 18 and optical beams which travel from emitter 24 to receivers 26 and 28. The first optical beam emanates from transmitter 24 to receiver 26, while the second beam emanates from transmitter 24 to receiver 28. As shown in FIGS. 2A through 2D, the golf ball 20 approaches the first optical beam (FIG. 2A), makes contact with that beam (FIG. 2B), then makes contact with the second optical beam (FIG. 2C) and completely passes the first optical beam (FIG. 2D).

FIG. 2A shows the golf ball 20 once putted and traveling in direction A towards the bounce beam 18 of the practice device 10. The golf ball 20 breaks the first beam as shown in FIG. 2B, which sends a signal to the microprocessor. As described herein, the practice device 10 does not need to be an integrated or all-in-one unit, such that the information when the optical beams are broken can be transmitted to a remote microprocessor for processing.

In an alternative embodiment, the information can be sent to a remote computer, a cellular telephone or a PDA, possibly using Bluetooth technology, for processing by the computer or PDA's microprocessor and display on the computer monitor or PDA's display.

Once the ball breaks the first beam, a timer (not shown) is started and two accumulators are incremented at a rate determined by the timer. The timer can be separate from or integrated into the microprocessor or microcontroller. Both accumulators begin tracking time, and when the ball breaks the second beam, as shown in FIG. 2C, accumulator 2 is latched. The time captured by accumulator 2 is saved and will be used later to calculate the ball position. The ball continues in direction A and, as shown in FIG. 2D, eventually clears the first beam which stops accumulator 1. The time saved from accumulator 1 is used to calculate the ball speed based on the time and the known size of the golf ball 20 as understood by one having ordinary skill in the art. Once the ball speed is calculated, and because the angle and position of the second beam is known, the time saved from accumulator 2 can be used to calculate the exact ball position in front of the device as known by one having ordinary skill in the art.

In alternative embodiments, additional emitters and receivers can be utilized to obtain similar results. With this information, the microprocessor can calculate the distance and the direction that the golf ball 20 would have traveled if it had not struck the bounce beam 18. This information 16 can be shown on the display 14 for the golfer to view and take into account to modify the next attempt.

In the preferred embodiment, foot switches 30, 32 are located on the top of the device 10 to simplify access for turning the device 10 on and off and to select the different games. For example, the switch 30 on the left side (when facing the device 10) can be depressed using one's foot to turn the device 10 on or off. Foot switches 30, 32 reduce the need for the golfer to bend over to turn on or off the device 10 or change games thereby making the device 10 easier and more enjoyable to use.

Once the device 10 has been turned on using the on/off switch 30, the golfer can use the game selector switch 32 to access one of the games, examples of which are described below, or the golfer can use the user preference selector 33 to select cup distance, stimp setting, game volume and more. For example, pressing user preference selector 33 once allows the golfer to set the cup distance (default 10 feet), which is the distance from the golf ball 20 at rest to the virtual cup (a range of 1 to 32 feet), also the center of the display 14. The second press of user preference selector 33 allows the golfer to enter the Stimp (default of 10), between 6 and 14. The third press of user preference selector 33 allows the golfer to enter the game distance (default 5 feet), which is the distance between the device 10 and where the golfer sets up to putt. The next press of user preference selector 33 allows the golfer to vary the game volume, and the final press of user preference selector 33 allows the device 10 to toggle between displaying feet or meters. These user preferences are in no particular order and these and additional user preferences can be added or removed without detracting from the objective of the invention. In the preferred embodiment, these switches 30, 32 are foot switches on the device 10, which can be controlled when the user steps on top of the switch 30, 32 to turn the device on or off, or to enter user preferences as described herein.

In the preferred embodiment, a coefficient of resistance, commonly known as the Stimp of the green, can be entered into the practice device 10 to simulate the putting conditions on a real golf course. In order to enter the Stimp, the golfer can use user preference selector 33, however, menu buttons, key pad, or touch screens which may or may not be incorporated into the display, can be used. The Stimp value can be used to modify the information 16 provided to the golfer. Thus, on a simulated green with a higher Stimp (faster), the display 14 will indicate that the golf ball 20 traveled further for the same putt than for a simulated course with a lower Stimp.

Multiple colored light emitting diodes (LEDs) (not shown) or other indicators can be used on or near the bounce beam to indicate the target where the golfer must aim the putt. In the preferred embodiment, a horizontal 96 segment LED array is located above the bounce beam 18, which has a reflective or semi-reflective surface. When a particular LED is illuminated, it is reflected on the bounce beam 18 and looks as though the bounce beam 18 is lit up at that location.

Other LEDs can be used to obtain similar results. For example, green LEDs can be used to indicate the green, with an unlit area or white LEDs used to indicate the hole or target. Once the golf ball 20 contacts the bounce beam 18, a white LED can also be used to show the contact location. In this example, the object is to light the white LED inside the unlit area.

Power can be provided to the practice device 10 either through an electrical cord (not shown) which is plugged into a standard wall outlet as understood by those having ordinary skill in the art, or the device 10 may be battery powered (not shown). If powered by batteries, the practice device 10 does not need to be plugged into a wall outlet and becomes even more portable. Further, the electrical connection can be a separate device that can be plugged in at times and removed at times for battery operation.

As detailed above, the practice device 10 returns the golf ball 20 to the golfer based on the bounce beam 18 and the fact that the golfer stands a shorter distance to the practice device 10 than the distance of the putt being practiced. Since there is no need for a mechanical device and the associated energy necessary to return the golf ball 20 to the golfer as in other golf putting practice devices, the practice device 10 of the present invention can be easily powered by standard batteries, rechargeable batteries or a battery pack whereas other devices need to be plugged into a wall outlet (or the equivalent) in order to function to return the golf ball 20 mechanically to the golfer.

The display 14 can be located in numerous positions to make viewing the information 16 on the display 14 easier for the golfer to see. In the preferred embodiment, the display 14 is located on the top of the device 10 and in the middle to where most of the putts are aimed. The display 14 can be round and in the shape and approximate size of an actual golf hole, thereby creating a visual aid in which the golfer is aiming the golf ball 20.

Figure 3:
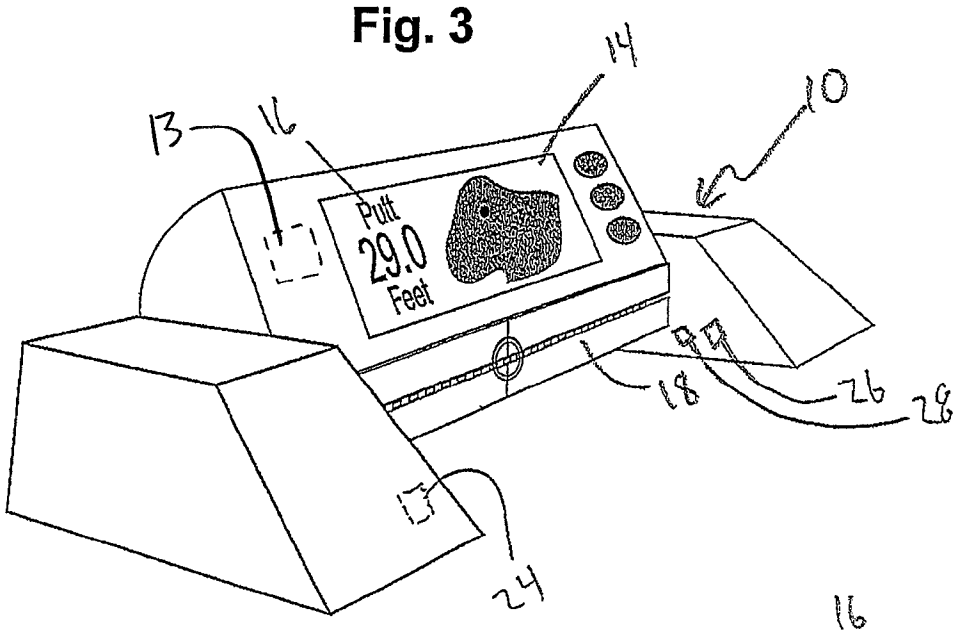
FIG. 3 is a perspective view of the golf putter practice device in accordance with an alternative embodiment of the present invention.
Figure 4:
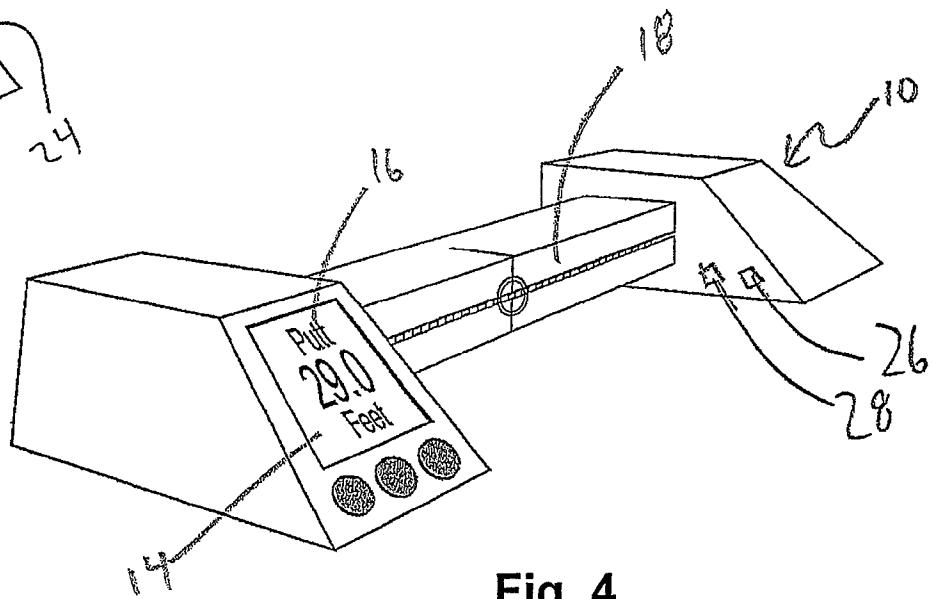
FIG. 4 is a perspective view of the golf putter practice device in accordance with an alternative embodiment of the present invention.

In alternative embodiments, the display may be removable to be located near the golfer with the information transmitted to and from the display using Bluetooth or another wired or wireless technology. FIG. 3 shows an alternative embodiment in which the display 14 is larger and also located in the center of the device 10, while FIG. 4 shows an embodiment with the display 14 on the left side. The bounce beam 18 is shown in FIGS. 3 and 4 in relation to the display 14, with the optical beam receivers 26 and 28 shown on the side of the practice device 10. FIGS. 3 and 4 show the practice device 10 as battery operated, so the practice device 10 can be easily transported from room to room, and used during travel, such as in a hotel room.

Figure 5:
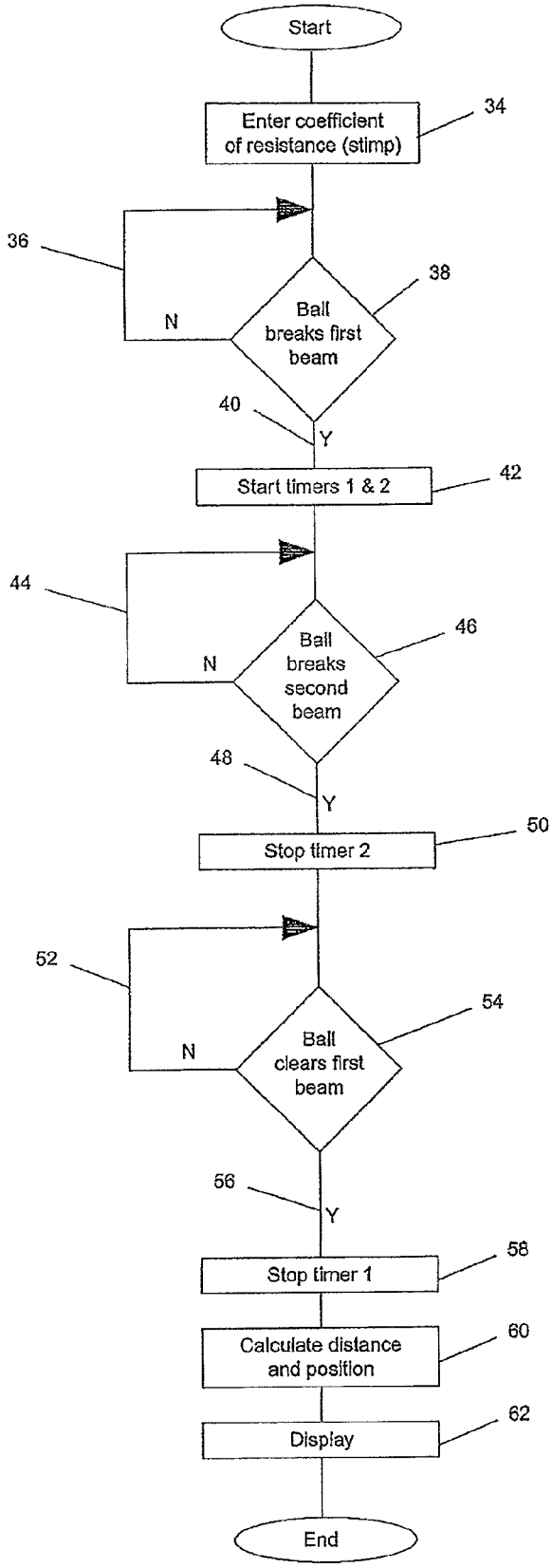
FIG. 5 is a flow chart of the golf putter practice device in accordance with the preferred embodiment of the present invention.

FIG. 5 is a flow chart describing the steps taken by the computer software to accomplish the functionality of the practice device 10. The program starts when the golfer turns on the practice device 10 by depressing the on/off button 30. The system can be set to run automatically such that no reset is necessary between practice putts. If the game uses a virtual cup, the user enters a virtual cup distance 34 If the game or mode uses a virtual Stimp, the golfer then enters a coefficient of resistance 34 or a Stimp value using the user preference selector 33. As described above, besides the user preference selector, the information may be entered by a keyboard, through touch screen or menu buttons. The practice device 10 will have a default reading so that if no reading is entered the golfer can still obtain information 16 on the display 14 based on his or her practice putts. The practice device 10 then enters a continuous loop 36 waiting for the golf ball 20 to interrupt or break the first beam 38. If no action occurs after a certain amount of time indicating no one is playing, the device 10 automatically shuts down to conserve battery life.

Once the golf ball 20 breaks the first beam 40 (FIG. 2B), a timer and accumulators 1 and 2 are started 42. These elements will be used to measure ball speed and direction. Once accumulators 1 and 2 are started 42, a second continuous loop begins 44, waiting for the second beam to be interrupted 46. Once the golf ball 20 breaks the second beam 48 (FIG. 2C), accumulator 2 is stopped and the elapsed time in accumulator 2 is saved 50. Accumulator 2 measures the amount of time it took for the leading edge of the ball to travel from beam 1 to beam 2.

Once accumulator 2 is stopped, continuous loop 44 waits for the trailing edge of the golf ball 20 to finally clear the first beam 54. Once the golf ball 20 clears the first beam 56 (FIG. 2D) accumulator 1 is stopped and the elapsed time in accumulator 1 is saved 58. Accumulator 1 measures the amount of time it took for the golf ball 20 to completely cross the first beam. Using the saved information obtained from the interruption of the two beams and the known diameter of a golf ball 20, the microprocessor can calculate the speed and position of the ball 20. Using this information and by factoring in the Stimp of the green (where applicable), the microprocessor can now display the "approximated" distance and direction the golf ball 20 would have traveled had it been allowed to continue traveling past the bounce beam 18 on a level putting green of selected Stimp speed 62. Further, the computer program can take into account the desired putt distance (previously entered by the user) and the ball direction to determine if the golf ball 20 was struck well enough to "hole-out" the desired putt length.

The practice device 10, either as a single unit or utilizing a separate box, can be connected to a personal computer to upload current or historical putting information for a golfer or player. Using wireless or wired technology, the practice device 10 can be coupled to a personal computer, a gaming console or directly to the Internet (or other devices, such as a large screen television), to access previous putting information, to display the information 16 as the golfer practices putting, or to play games, alone or against others online. Further, the present invention can be incorporated into a video arcade game, for example, an upright version that utilizes a matt, golf putter and golf ball, either for commercial purposes (in which a coin or token is used to access game operation), or a consumer version that is placed in the home. The golfer can practice putting against the machine in which a video display provides numeric or graphic information pertaining to the putted golf ball.

As an example, using the Internet, a miniature golf game can be accessed in which each player must hit the golf ball 20 a certain distance and around certain obstacles. The device 10 will keep track of the number of shots for each player and the location of each golf ball 20 in relation to the obstacles.

As described herein, numerous games can be programmed to the device 10 to allow golfers to challenge themselves, each other and, in general, make practicing and perfecting the putting portion of the golf game, a lot more enjoyable.

One of the many games described herein is a game of accuracy in which a golfer putts the ball a number of times and receives a score based on accuracy for each putt. The device 10 accumulates the score, thereby allowing the golfer to challenge his or her own score or that of another. In the preferred embodiment, the game is called 500 and a player must putt a golf ball 20 five times, each time the ball contacts the bounce beam 18, a score of up to 100 is registered and revealed to the golfer. In this game, 100 points are awarded for a direct hit to the center target, with reducing scores for less accurate putts. The present invention keeps track of the five different scores and displays a total after all five shots, with 500 being a perfect score. The game can be played by one person (trying to better his or her score), or by multiple players each trying to register the highest score.

Another game that can be programmed in the device 10 starts with all of the LEDs illuminated in the center target (which is the width of a regulation hole on a golf course) and challenges the player to turn off all of the LEDs with the least number of putts. At the start of the game, all of the LEDs in the target are illuminated and visible, either directly or reflected off of the bounce beam 18. The golfer then putts the golf ball 20 at the device 10, and the LEDs near the point where the golf ball 20 makes contact with the bounce beam 18 are then turned off. This is repeated by the golfer until all of the LEDs are turned off. The display 16 then indicates how many putts it took for the player to turn off all of the LEDs. For example, if 16 LEDs are illuminated at the beginning of the game and each putt can turn off four LEDS, then four precise putts can turn off all of the LEDs, and the display will show a four. However, if it takes six putts to turn off all of the LEDs, the display will indicate a six to the golfer. This type of game, also known as Knockout, can be played by multiple players, each trying for the least number of putts to eliminate the LEDs, or it can be played by one, trying to better the lowest score each time.

In another game play, a player obtains points by hitting the golf ball into the area where the LEDs are illuminated. After each successful putt, points are accumulated and the number of LEDs illuminated is reduced, making the next putt (and the chance at points) that much more difficult. The game is called Diminishing Hole and in an embodiment, after three misses, the game ends. In another embodiment of this same game, the illuminated LEDs (or LED) moves from side to side and the golfer's objective is to hit the bounce beam 18 with the golf ball 20 at the same time the particular LED is illuminated.

These are just a few of the games that can be programmed to be played using the device 10. Of course, numerous games can be programmed into the system or in an alternative embodiment; the device 10 can have a USB port such that additional games can be added to the memory at a later time.

Further, game programs or additional features can be downloaded to the device 10 for a period of time, such as a trial period. Downloads can occur in a number of ways customary in the industry, such as through a USB port, Bluetooth, etc. During the trial period, the user of the device 10 can access and use those game programs or features to "try them out". At the end of the trial period, the user will no longer be able to access those game programs or features without paying a fee.

In another embodiment, a user will receive a basic game program or basic features that do not contain all of the functionality of those game programs or features. The golfer can use the basic game programs or features and upgrade to the additional functionality if desired.

Although the preferred embodiment is a golf putting practice device 10, there are numerous applications that can be utilized using this same technology. For example, a larger scale bowling simulator, in which lane conditions can be simulated and a bowling ball can be rolled a short distance to the device. The display can take the data from the bowling ball passing the optical sensors and simulate a bowling ball traveling down the lane to the pins. A game can be played in which, depending on the data from the rolled ball, certain pins will be knocked down as shown on the display. Videos pertaining to different bowling scenarios can be stored and accessed when necessary. Subsequently, the player will have to knock down the remaining pins, similar to an actual bowling game.

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless come within the scope of the invention and range of the claims.

The invention claimed is:

1. A method of practicing the putting of a golf ball utilizing a golf putting practice device having a bounce beam, said golf putting practice device having sufficient weight for receiving a putted golf ball from a golfer and for returning said golf ball to the golfer without said golf putting practice device moving a noticeable amount, wherein said golf putting practice device has at least one sensing element, said sensing element comprising at least two optical beams with a first optical beam traveling in a direction approximately perpendicular to the direction of travel of the putted golf ball and a second optical beam traveling at a known angle in relation to said first optical beam; a timing element capable of capturing timing information pertaining to the putted golf ball; a microprocessor coupled to the timing element, wherein said golf putting practice device has no moving parts necessary for returning said golf ball to said golfer, comprising the steps of:

a. placing said golf putting practice device a distance from said golfer that is less than the distance that the golfer intends the putted golf ball to travel;

b. allowing for a golfer to putt a golf ball at said bounce beam;

c. interrupting said putted golf ball using said bounce beam; and d. returning said putted golf ball to said golfer, without the use of moving parts.

2. The method of practicing the putting of a golf ball in claim 1, further comprising a display element, said display element coupled to said microprocessor and capable of receiving display information from said microprocessor to be displayed to said golfer.

3. The method of practicing the putting of a golf ball in claim 1, wherein said second optical beam is approximately parallel to said first optical beam.

4. The method of practicing the putting of a golf ball in claim 1, wherein said timing element comprises at least one timer and at least two accumulators, a first accumulator capable of capturing the time it takes for the putted golf ball to cross said first optical beam, and a second accumulator capable of capturing the time it takes for the putted golf ball to travel from said first optical beam to said second optical beam.

5. The method of practicing the putting of a golf ball in claim 1, wherein said display element comprises a digital display.

6. The method of practicing the putting of a golf ball in claim 5, wherein said digital display displays information about said putted golf ball comprising at least one of an approximate distance of travel of the putted golf ball had the putted golf ball not contacted the bounce beam, an approximate speed of the putted golf ball at the time the putted golf ball contacted the bounce beam, a direction of the putted golf ball, a user preference and a game result information.

7. The method of practicing the putting of a golf ball in claim 6, further comprising a second digital display, said second digital display comprising a linear array.

8. The method of practicing the putting of a golf ball in claim 6, wherein said distance of travel of the putted golf ball had the putted golf ball not contacted the bounce beam is based in part on a coefficient of rolling resistance.

9. The method of practicing the putting of a golf ball in claim 1, wherein said sensing element comprises at least two accelerometers, piezoelectric sensors, microphones, or strain gauges configured to obtain impact data from said putted golf ball contacting said bounce beam.

10. The method of practicing the putting of a golf ball in claim 1, further comprising at least one foot switch, said at least one foot switch configured to be activated with the golfer's foot to turn the golf putting practice device on or off and to enter at least one golfer's preference.

* * * * *